US007431636B2

(12) United States Patent
Chuang

(10) Patent No.: US 7,431,636 B2
(45) Date of Patent: Oct. 7, 2008

(54) ADJUSTMENT DEVICE FOR ADJUSTING A LEVEL DIFFERENCE BETWEEN ROLLERS OF A ROLLER BELT SANDER

(76) Inventor: Po Chang Chuang, No. 222, Tsung-Yi 6th St., Taiping City, Taichung (TW) 411

( * ) Notice: Subject to any disclaimer, the term of this patent is extended or adjusted under 35 U.S.C. 154(b) by 209 days.

(21) Appl. No.: 11/580,287

(22) Filed: Oct. 13, 2006

(65) Prior Publication Data

US 2008/0090492 A1 Apr. 17, 2008

(51) Int. Cl.
*B24B 7/06* (2006.01)

(52) U.S. Cl. ..... 451/184; 451/65

(58) Field of Classification Search ..... 451/331, 451/11, 65, 184, 188
See application file for complete search history.

(56) References Cited

U.S. PATENT DOCUMENTS 1,373,193 A * 3/1921 Lumsden ..... 451/363
1,841,411 A * 1/1932 Kux ..... 451/305
3,577,684 A * 5/1971 Jakimcius ..... 451/297
4,043,082 A * 8/1977 Ferroglio ..... 451/311
4,707,946 A * 11/1987 Hirohata ..... 451/283
5,165,203 A * 11/1992 Chuang ..... 451/297
6,213,694 B1 * 4/2001 Ichikawa ..... 409/139

* cited by examiner

*Primary Examiner*—Robert Rose
(74) *Attorney, Agent, or Firm*—Ming Chow; Sinorica, LLC

(57) ABSTRACT

An adjustment device for adjusting a level difference between rollers of a roller belt sander includes a base, an eccentric shaft and a restricting knob. The base is fixed on an interior wall edge of a main body corresponding to two ends of a roller. The eccentric shaft inserted pivotally in a penetrating opening of the base has a rear end portion, and a front-end engaging portion formed eccentrically to engage with the roller pivotally. The restricting knob is engaged in a threaded hole of the base to fix the eccentric shaft. Therefore, the adjustment device can be turned to enable the roller positioned at a level for preferable grinding.

7 Claims, 7 Drawing Sheets

ADJUSTMENT DEVICE FOR ADJUSTING A LEVEL DIFFERENCE BETWEEN ROLLERS OF A ROLLER BELT SANDER

BACKGROUND OF THE INVENTION

1. Field of the Invention

This invention relates to a roller belt sander, particularly to one installed with adjustment devices that can quickly and precisely keep a roller positioned via an eccentric micro-adjustment to achieve a preferable grinding effect.

2. Description of the Prior Art

As shown in FIG. 1, a conventional roller belt sander 10 consists of a main body 11, a front belt sanding roller 12 and a rear belt sanding roller 13 set in the top of the main body 10, and a conveying table 14. A work to be sanded is put on the conveying table 14 and transferred underneath the front belt sanding roller 12 and the rear belt sanding roller 13 orderly. The rear belt sanding roller 13 is provided with a bearing base 131 at its two ends respectively fixed on the wall of the main body 10 and installed with an adjustment device 20 for adjusting the height of the rear belt sanding roller 13. The adjustment device 20 is composed of a base 21, sliding base 22, a shaft base 23, a knob 24 and a locking grip 25. The base 21 is fixed on a wall edge of the main body 10 corresponding to one end of the rear belt sanding roller 13, and the sliding base 22 has its one side connected with the rear belt sanding roller 13 and the other side slid to fit restrictively with the base 21. The shaft base 23 is positioned at a top edge of the base 21, the knob 24 is rotatable to link with the sliding base 22 so as to keep the rear belt sanding roller 13 moved up and down, and the locking grip 25 is able to be whirled to fix the sliding base 22 tightly on the base 21 so that the bearing base 131 may be fixed in the sliding base 22. Then the rear belt sanding roller 13 can be positioned at a most appropriate level to co-work with the front belt sanding roller 12 to achieve a preferable grinding. But, it takes some time for the knob 24 to rotate to adjust the height of the rear belt sanding roller 13 in order to move the sliding base 22 first. Moreover, the adjustment device 20 has too many elements to cause a complicated assembly and a high manufacturing cost.

SUMMARY OF THE INVENTION

The objective of this invention is to offer an adjustment device for adjusting a level difference between rollers of a roller belt sander.

The main characteristics of the invention are a base, an eccentric shaft and a restricting knob. The base is fixed on an interior wall edge of a main body corresponding to two ends of a roller. The eccentric shaft inserted pivotally in a penetrating opening of the base has a rear end portion, and a front-end engaging portion formed eccentrically to engage with the roller pivotally. The restricting knob is engaged in a threaded hole of the base to fix the eccentric shaft. Therefore, the adjustment device can be turned to enable the roller positioned at a level for preferably grinding. Moreover, the adjustment device has fewer components so that it can be assembled easily to save cost.

BRIEF DESCRIPTION OF DRAWINGS

This invention is better understood by referring to the accompanying drawings, wherein.

DETAILED DESCRIPTION OF THE PREFERRED EMBODIMENT

Figure 1:
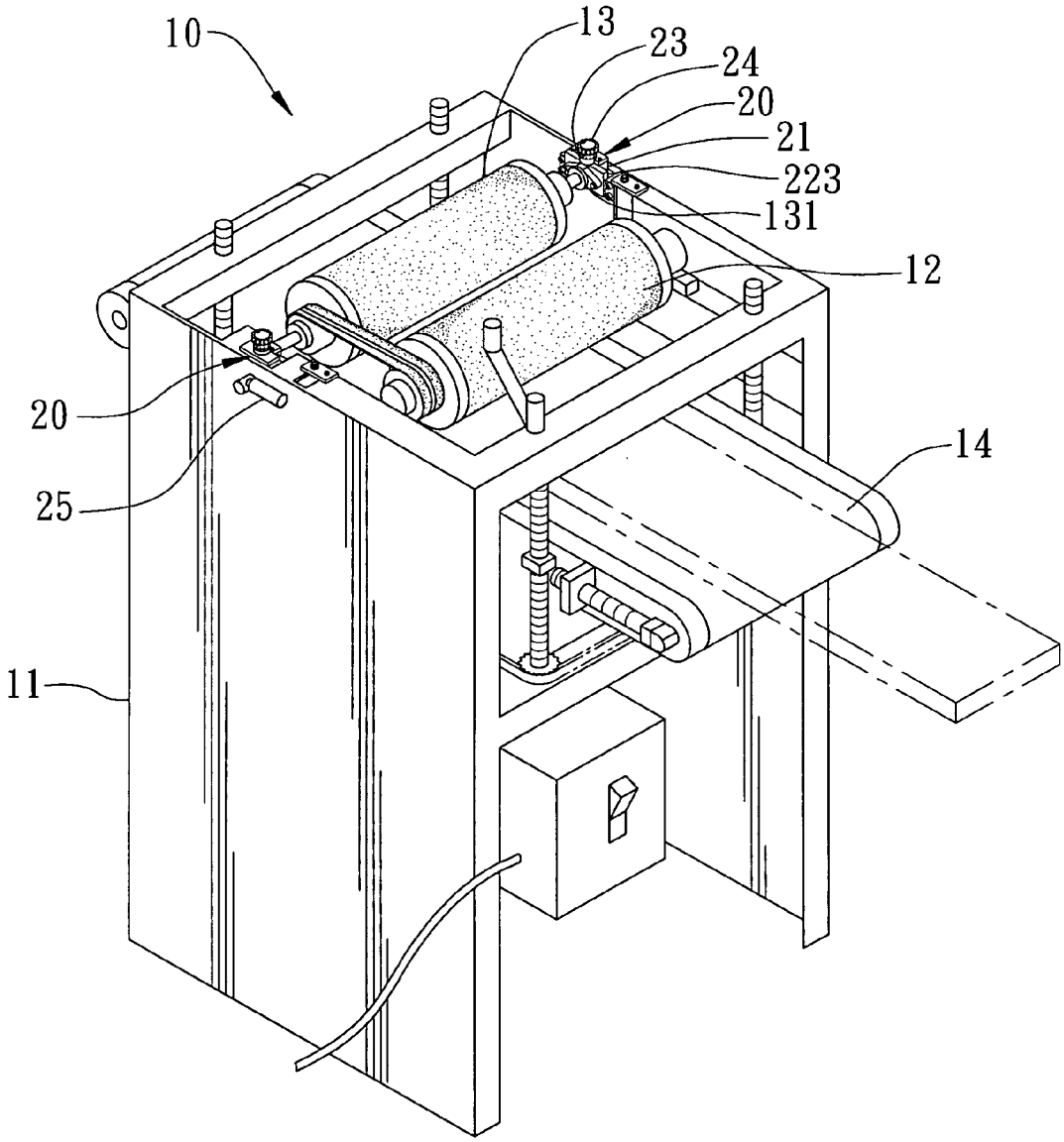
FIG. 1 PRIOR ART
FIG. 1 is a perspective view of a conventional roller belt sander.
Figure 2:
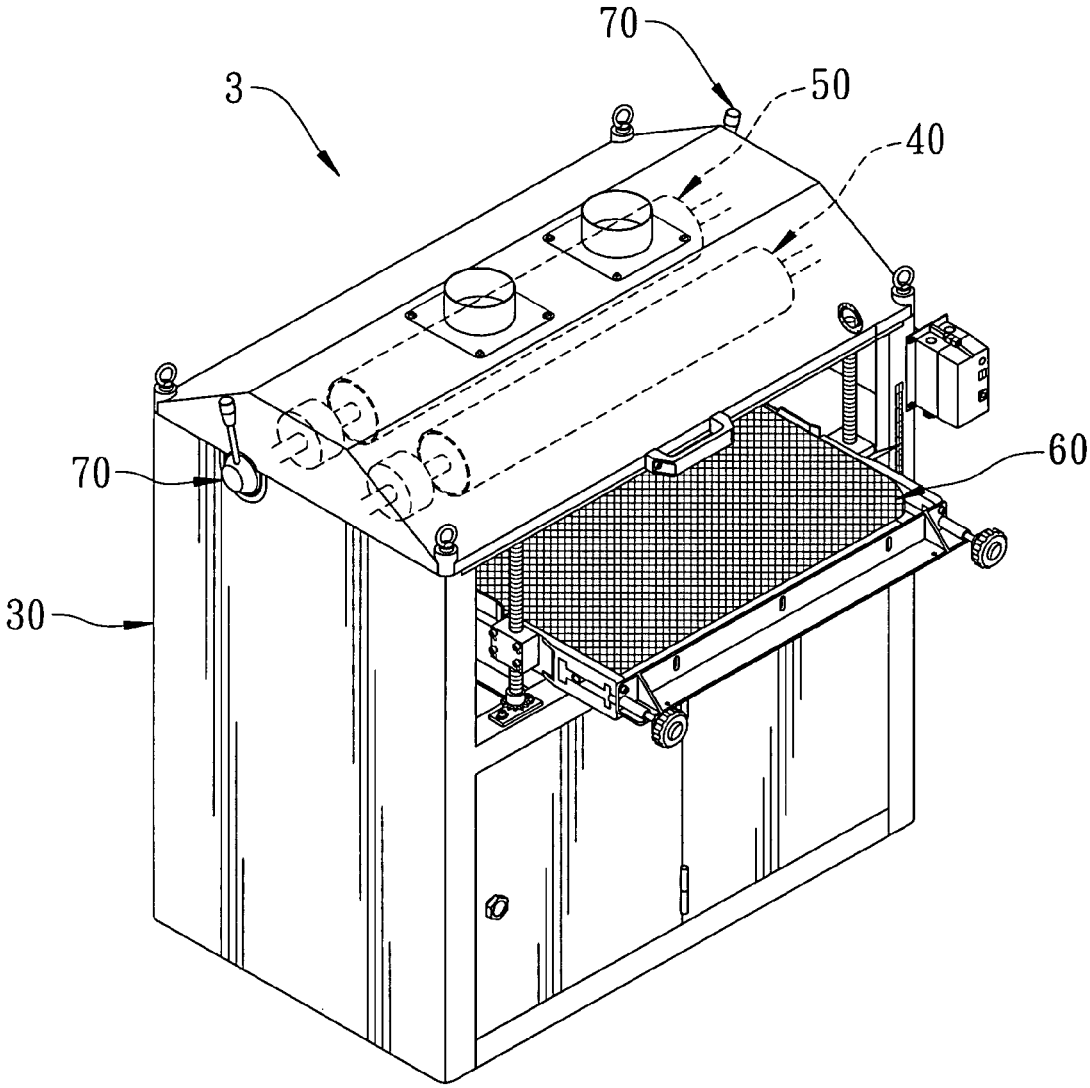
FIG. 2 is a perspective view of a roller belt sander in the present invention.
Figure 3:
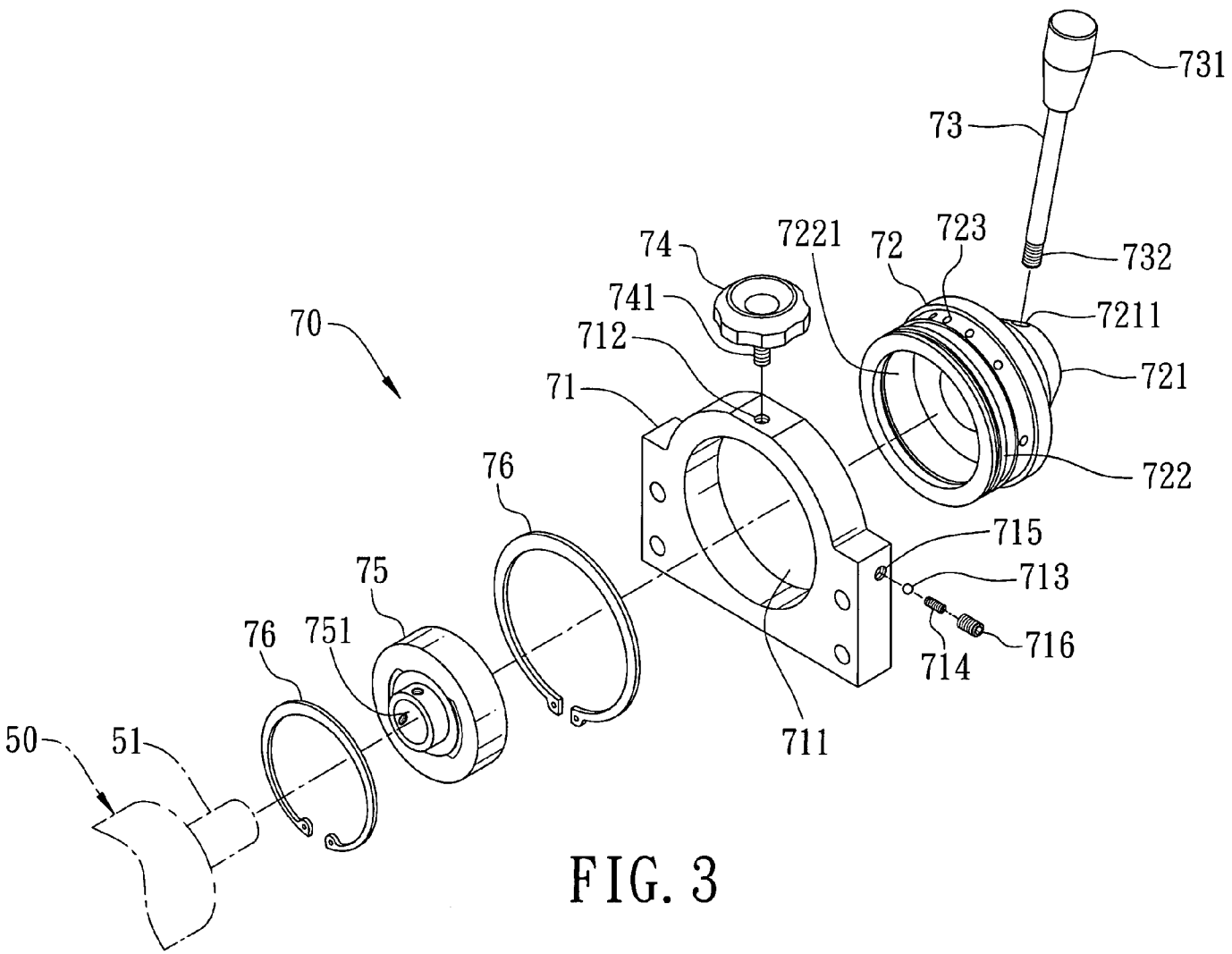
FIG. 3 is an exploded perspective view of a first preferred embodiment of an adjustment device for adjusting a level difference between rollers of a roller belt sander in the present invention.

FIGS. 2 and 3 show a first preferred embodiment of an adjustment device 70 for adjusting a level difference between rollers of a roller belt sander 3 in the present invention. The roller belt sander 3 is composed of a main body 30, a front belt sanding roller 40, a rear belt sanding roller 50, and a conveying table 60 installed under the front belt sanding roller 40 and the rear belt sanding roller 50 for carrying a work to be ground via passing underneath the front belt sanding roller 40 and the rear belt sanding roller 50. Each of the adjustment devices 70, which is set between a bearing 51, provided respectively at two ends of the rear belt sanding roller 50, and a wall edge of the main body 30 to adjust the level of the rear belt sanding roller 50, is composed of a base 71, an eccentric shaft 72, a rotating rod 73, a restricting knob 74, a bearing base 75 and two locking rings 76.

The base 71 is fixed on an interior wall of the main body 30 corresponding to each end of the rear belt sanding roller 50, provided with a penetrating opening 711 bored axially, a threaded hole 712 bored in its top center, a hole 715 bored at a preset sidewise location for accommodating a locking ball 713 and a compression spring 714 in order, and a tightening bolt 716 screwed on the top of the hole 715 to squeeze the compression spring 714 to restrict the locking ball 713. The rear end of the hole 715 is tapered to a smaller diameter, so that the locking ball 713 is to be stopped therein with a part of it extruded outside the hole 715.

The eccentric shaft 72 inserted in the penetrating opening 711 of the base 71 has a rear end portion 721 and bored with a threaded hole 7211 on its top, a front-end engaging portion 722 to have an opening 7221 cut near around its edge for pivotally receiving the bearing 51 of the rear belt sanding roller 50, and a preset number of ball recesses 723 concaved around its annular rim. The opening 7221 formed to rotate eccentrically is pivotally positioned in the penetrating opening 711 of the base 70, and a locking ring 76 is to fit tightly around the bearing base 75.

The rotating rod 73 consists of a grip 731 set at its top for a user to grab easily, and a threaded bar 732 located at its lower portion for engaging in the threaded hole 7211 of the eccentric shaft 72 so that the rotating rod 73 is able to keep the eccentric shaft 72 whirling eccentrically up and down.

The restricting knob 74 is provided with a threaded portion 741 located at its lower portion for engaging with the threaded hole 712 of the base 71 so as to fix deadly the eccentric shaft 72 in the penetrating opening 711 of the base 71 after having the eccentric shaft 72 being adjusted to a desired position.

The bearing base 75 mounted by the locking ring 76 and pivotally inserted in the opening 7221 of the eccentric shaft 72 is provided with an axial hole 751 bored axially for accommodating the bearing 51 of the rear belt sanding roller 50.

Figure 4:
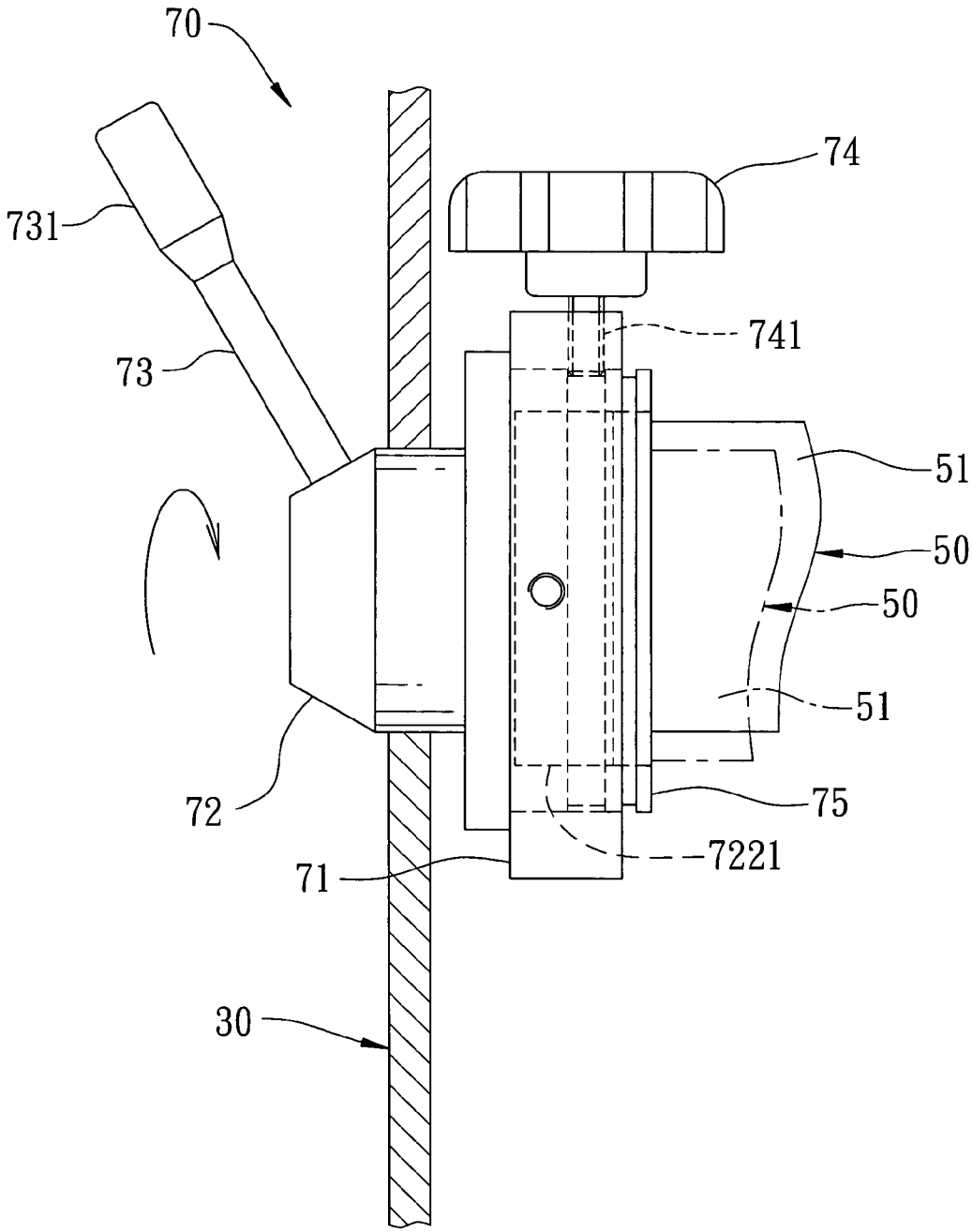
FIG. 4 is a side view of the first preferred embodiment of an adjustment device for adjusting a level difference between rollers of a roller belt sander in the present invention, showing it being working.
Figure 5:
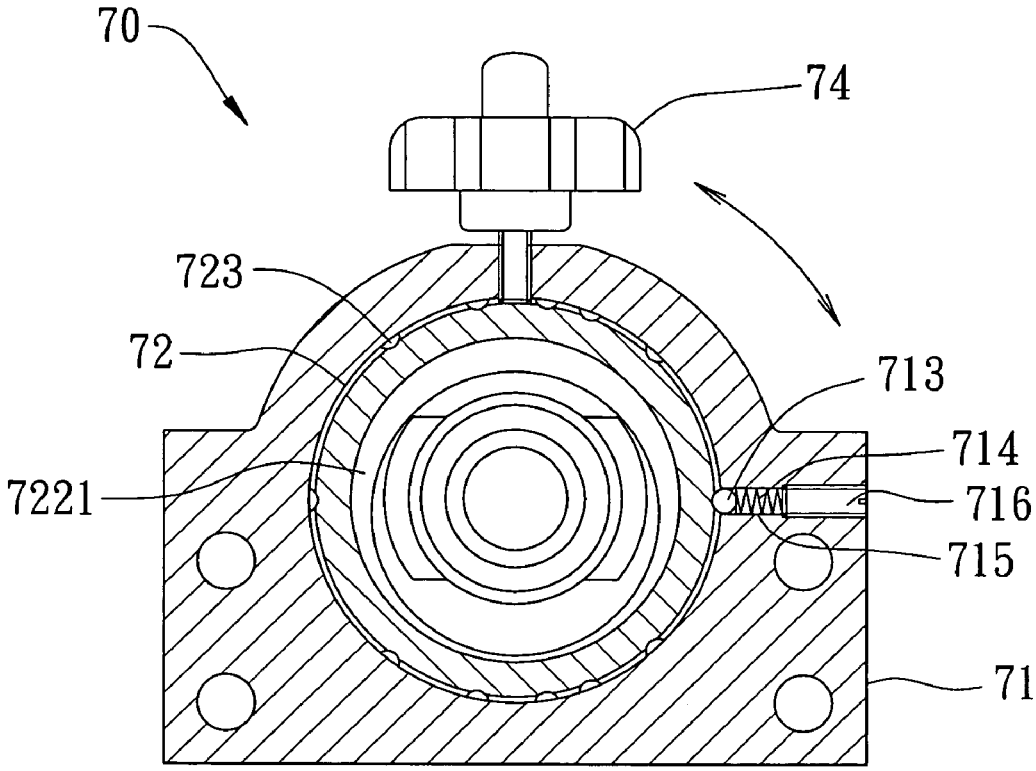
FIG. 5 is a front cross-sectional view of the first preferred embodiment of an adjustment device for adjusting a level difference between rollers of a roller belt sander in the present invention, showing it being positioned.

In using, as shown in FIGS. 4 and 5, when the level of the rear belt sanding roller 50 is to be adjusted, the restricting knob 74 has to be first turned loosely to loosen the base 71 and the eccentric shaft 72, and then rotate the rotating rod 73 according to numbers matched between the front belt sanding roller 40 and the rear belt sanding roller 50, so as to enable the eccentric shaft 72 to whirl eccentrically to keep the rear belt sanding roller 50 moved up or down. It should be noted that the locking ball 713 can be trapped in any of the ball recesses 723 to get restricted when the rotating rod 73 drives the eccentric shaft 72 to rotate, enabling the adjustment device 70 to move the rear belt sanding roller 50 up and down with various segmented levels, achieving a preferable grinding effect in conjunction with the front belt sanding roller 40.

Figure 6:
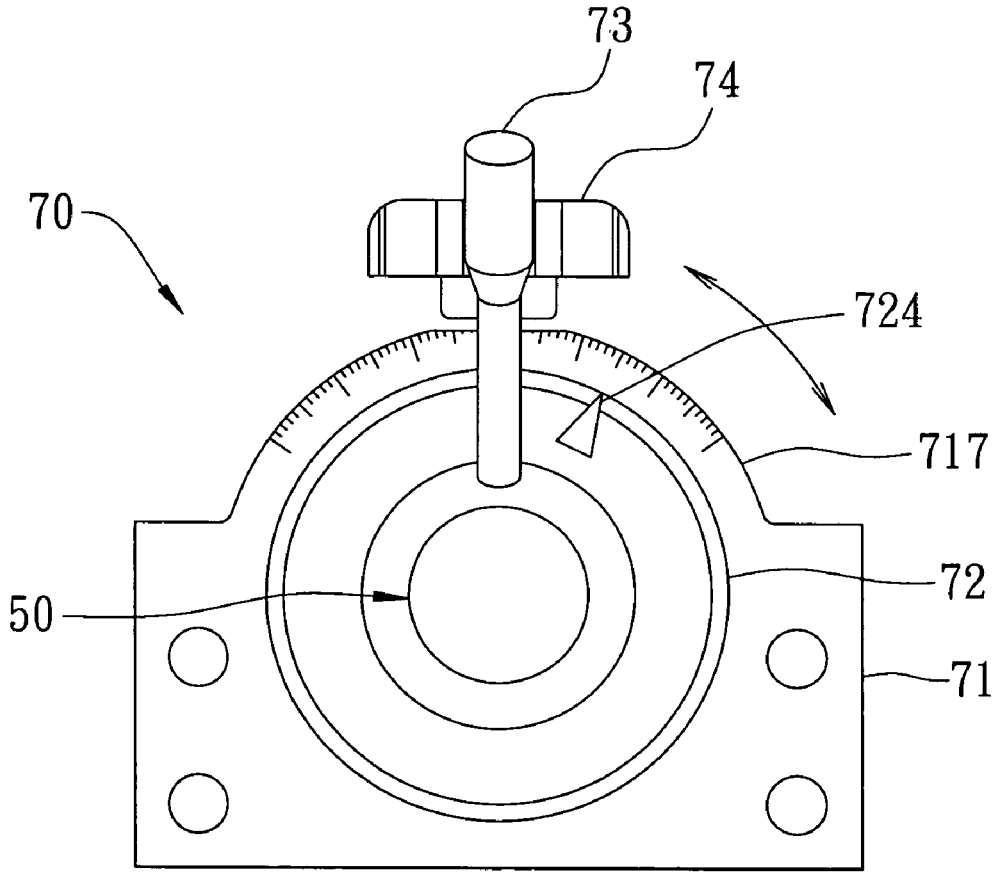
FIG. 6 is a front view of a graduation ruler of a second preferred embodiment of an adjustment device for adjusting a level difference between rollers of a roller belt sander in the present invention.

As shown in FIG. 6, a second preferred embodiment of an adjustment device 70 for adjusting a level difference between rollers of a roller belt sander 3 in the present invention has the same parts as the first embodiment does, except that a graduation ruler 717 is additionally provided in the base 71 located at a top arc of one side of the base 71 facing to the rotating rod 73. The eccentric shaft 72 is additionally provided with a pointer 724 set at a preset position corresponding to the graduation ruler 717 so as to indicate a scope the eccentric shaft 72 rotates. Therefore, the rotating rod 73 can be turned according to an indication the pointer 74 points at the graduation ruler 717, so that the rear belt sanding roller 50 can be moved up or down to a desired level.

Figure 7:
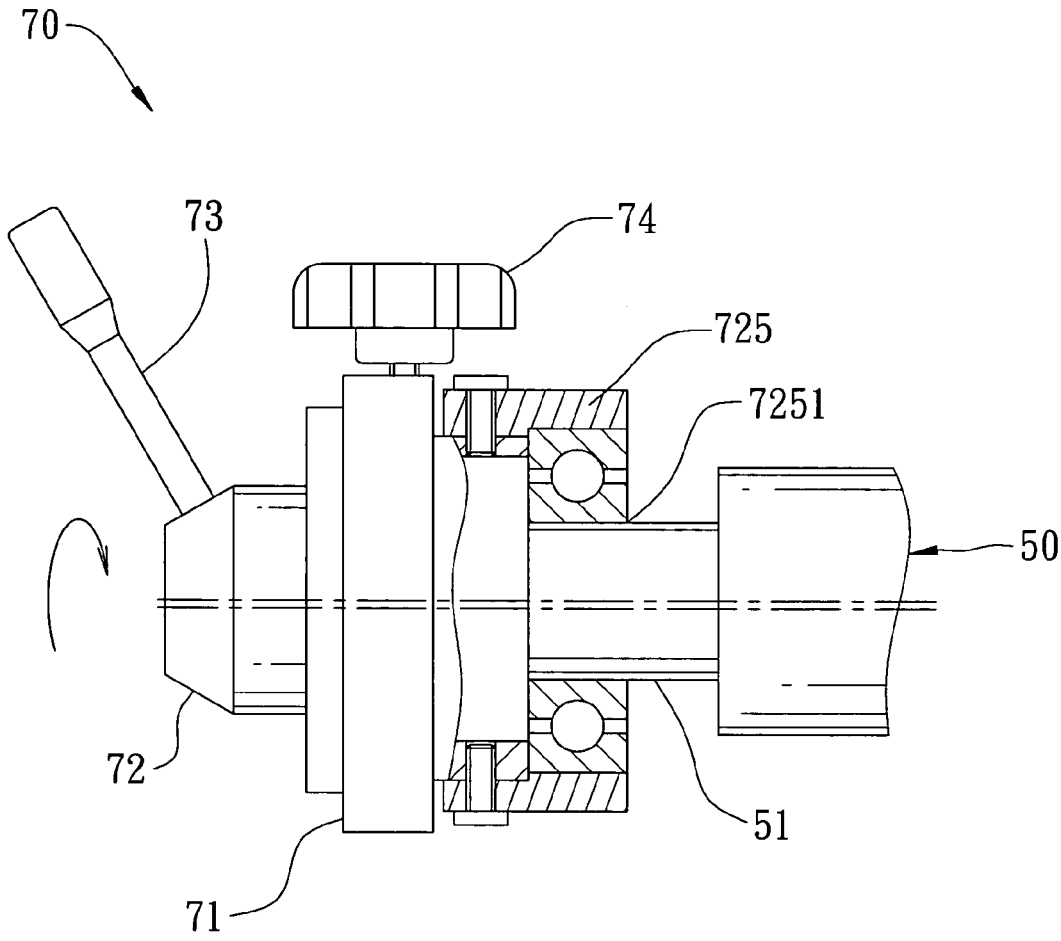
FIG. 7 is a cross-sectional view of a third preferred embodiment of an adjustment device for adjusting a level difference between rollers of a roller belt sander in the present invention, showing it being assembled.

As shown in FIG. 7, a third preferred embodiment of two adjustment devices 70 for adjusting a level difference between rollers of a roller belt sander 3 in the present invention has the same parts as the first embodiment does, except that the eccentric shaft 72 is provided with a sleeve 725, which, fixed at one side of the eccentric shaft 72 facing to the rear belt sanding roller 50, is composed of an axial hole 7251 cut axially for pivotally fitting with the bearing 51 of the rear belt sanding roller 50, so that the sleeve 725 can be driven by the engaging portion 722 to rotate eccentrically to drive the rear belt sanding roller 50 to move up and down.

The invention has the following advantages as can be seen from the foresaid description.

1. The engaging portion 722 of the eccentric shaft 72 can be provided with an eccentric opening or an eccentric outer diameter to drive the rear belt sanding roller 50 to move up and down.

2. With the locking ball 713 squeezed to match restrictively with any of the ball recesses 723 of the eccentric shaft 72, the eccentric shaft 72 can rotate eccentrically with various steps for changing the level of the rear belt sanding roller 50.

3. It needs only to grab the rotating rod 73 to operate the adjustment device 70 in the present invention for quickly and conveniently carrying out adjustment.

4. The adjustment device 70 in the present invention has so less components that it can be assembled easily for saving its manufacturing cost.

While the preferred embodiment of the invention has been described above, it will be recognized and understood that various modifications may be made therein and the appended claims are intended to cover all such modifications that may fall within the spirit and scope of the invention.

What is claimed is:

1. An adjustment device for adjusting a level difference between rollers of a roller belt sander, said roller belt sander composed of a main body, two rollers installed on said main body, and a conveying table located under said rollers, one of said rollers set with said adjustment device at its two ends respectively, said adjustment device comprising:

a base fixed on an interior wall of said main body corresponding to each end of said rear belt sanding roller, and provided with a penetrating opening and a threaded hole bored on its top center;

an eccentric shaft inserted pivotally in said penetrating opening of said base and provided with a rear end portion, and a front-end engaging portion formed eccentrically for pivotally matching with said roller;

a restricting knob provided with a threaded portion located at its lower portion for engaging in said threaded hole of said base so as to fix said eccentric shaft deadly in said penetrating opening of said base after having it being adjusted to a desired position; and each of said rollers is provided with a bearing base mounted at two ends respectively of said each roller for pivotally engaging with said eccentric shaft.

2. The adjustment device for adjusting a level difference between rollers of a roller belt sander as claimed in claim 1, wherein said rear end portion of said eccentric shaft is provided with a threaded hole bored in its top for a threaded bar provided in a lower portion of a rotating rod to engage in, so that said rotating rod can be turned to drive said eccentric shaft rotated to move said roller up and down.

3. The adjustment device for adjusting a level difference between rollers of a roller belt sander as claimed in claim 1, wherein said front-end engaging portion of said eccentric shaft is provided with an opening formed eccentrically to enable said roller to move up and down.

4. The adjustment device for adjusting a level difference between rollers of a roller belt sander as claimed in claim 1, wherein said eccentric shaft is provided with a preset number of ball recesses concaved around its annular rim, a hole bored at a preset position of said base corresponding to any of said ball recesses for accommodating a locking ball and a compression spring orderly, a tightening bolt screwed in a top of said hole to compress said compression spring to squeeze said locking ball, said hole having its bottom tapered to just stop said locking ball with part of it extruded outside said hole for said locking ball to be compressed to match deadly with any of said ball recesses.

5. The adjustment device for adjusting a level difference between rollers of a roller belt sander as claimed in claim 1, wherein said rotating rod is provided with a grip sleeved in its top for grabbing easily.

6. The adjustment device for adjusting a level difference between rollers of a roller belt sander as claimed in claim 1, wherein said base is provided with a graduation ruler located at one side to face to said rotating rod, said eccentric shaft provided with a pointer set at a preset position corresponding to said graduation ruler to indicate a level difference that said roller is to be adjusted by said rotating rod.

7. The adjustment device for adjusting a level difference between rollers of a roller belt sander as claimed in claim 1, wherein said front-end engaging portion of said eccentric shaft is formed eccentrically with its outer diameter, said eccentric shaft provided with a sleeve mounted steadily at its one side to pivotally engage with said roller so as to change a level of said roller.

* * * * *